United States Patent [19]

Grossman et al.

[11] Patent Number: 4,678,550

[45] Date of Patent: Jul. 7, 1987

[54] OBTAINING ACCURATE AMOUNTS OF MERCURY FROM MERCURY COMPOUNDS VIA ELECTROLYTIC METHODS

[75] Inventors: Mark W. Grossman, Belmont; William A. George, Rockport, both of Mass.

[73] Assignee: GTE Products Corporation, Danvers, Mass.

[21] Appl. No.: 815,146

[22] Filed: Dec. 31, 1985

[51] Int. Cl.[4] ..... C25C 1/00

[52] U.S. Cl. ..... 204/105 R

[58] Field of Search ..... 204/45.1, 105 R

[56] References Cited

U.S. PATENT DOCUMENTS 3,639,222 2/1972 Scheiler et al. ..... 204/105 R 3,673,406 6/1972 Nief et al. ..... 250/43

OTHER PUBLICATIONS

*Photochemical Isotope Separation of HG-196 by Reaction with Hydrogen Halides,* Webster, C. R. and Zare, R. N., J. Phy. Chem., 85, 1302-1305 (1981).

*Photochemical Enrichment of Hg-196,* Grossman, M., and Maya, J., XIII, Intern. Elec. Con. Tech. Dig., 139-140 (Jun. 18-21, 1984).

*Energy Conservation Through More Efficient Conservation,* Maya, J., Grossman, M. W., Lagushenko, R., Waymouth, J. F., Science, 226, 435-436 (Oct. 26, '84).

*Primary Examiner*—R. L. Andrews

*Attorney, Agent, or Firm*—Hamilton, Brooks, Smith & Reynolds

[57] ABSTRACT

A process for obtaining pre-determined, accurate rate amounts of mercury. In one embodiment, predetermined, precise amounts of Hg are separated from HgO and plated onto a cathode wire. The method for doing this involves dissolving a precise amount of HgO which corresponds to a pre-determined amount of Hg desired in an electrolyte solution comprised of glacial acetic acid and $H_2O$. The mercuric ions are then electrolytically reduced and plated onto a cathode producing the required pre-determined quantity of Hg. In another embodiment, pre-determined, precise amounts of Hg are obtained from $Hg_2Cl_2$. The method for doing this involves dissolving a precise amount of $Hg_2Cl_2$ in an electrolyte solution comprised of concentrated HCl and $H_2O$. The mercurous ions in solution are then electrolytically reduced and plated onto a cathode wire producing the required, pre-determined quantity of Hg.

18 Claims, 1 Drawing Figure

OBTAINING ACCURATE AMOUNTS OF MERCURY FROM MERCURY COMPOUNDS VIA ELECTROLYTIC METHODS

GOVERNMENT RIGHTS

The Government has rights in this invention pursuant to Subcontract 4524210 under Prime Contract DE-AC03-76SF00098 awarded by the U.S Department of Energy.

FIELD OF THE INVENTION

This invention is in the field of inorganic chemistry. More particularly, it relates to obtaining pre-determined milligram and submilligram amounts of Hg via electrolyte means.

BACKGROUND OF THE INVENTION

Many devices require for their operation exact milligram and submilligram amounts of mercury. An example of a device which uses small quantities of mercury is the arc discharge lamp. Virtually all of these lamps employ mercury as one of the vaporizable components. In current commercial lamps such as fluorescent lamps, it is common practice to mechanically dispense a drop of natural mercury into the lamp. This practice of mechanically dispensing mercury or other material works well because natural mercury is a fairly inexpensive commodity costing about $0.30/gram. A mercury droplet can also be contained within a small capsule which is placed in the lamp and opened after a lamp is sealed. See U.S. Pat. No. 3,913,999.

Recently it has been determined that the efficiency of certain lamps, i.e., low pressure mercury-rare gas discharge lamps, can be enhanced if the isotopic mixture of the mercury is changed from that which occurs naturally. See, for example, Electric Discharge Lamps, MIT Press, 1971, by J. Waymouth for basic principles of low pressure mercury rare gas discharge lamps and U.S. Pat. No. 4,379,252. The latter patent teaches efficiency gains in fluorescent lamps when the $^{196}Hg$ isotope is increased from its natural occurrence of about 0.14% to about 3%.

Enriched isotopes of mercury are very expensive. For example, at current prices, mercury which has been enhanced to contain 35% of the $^{196}Hg$ isotope costs about $500/milligram (mg). Accordingly, it can be seen that use of this material requires very strict controls on the amount employed. Further, such materials need only be used in submilligram or milligram amounts.

It is very difficult to weigh out milligram and submilligram amounts of mercury. A microscopic technique has been used in the past to obtain milligram and submilligram amounts of Hg. Different size grids corresponding to different masses of mercury are placed under a microscope. One obtains specific milligram and submilligram amounts of mercury by selecting a specific grid and placing a sufficient amount of mercury onto the grid to cover the grid, thus, obtaining the amount of Hg desired. This method is very time consuming and difficult due to the extreme difficulty of handling such minute amounts of mercury. This process is also very expensive due to the fact that accidents can easily occur resulting in a loss of mercury. Also, this method is dangerous to workers due to their exposure and handling of toxic mercury.

SUMMARY OF THE INVENTION

This invention provides a unique and novel method for obtaining pre-determined, accurate milligram or submilligram amounts of mercury from mercury compounds onto cathode wires.

In one embodiment, precise pre-determined milligram or submilligram amounts of Hg are separated from mercuric oxide (HgO) and plated onto a cathode wire. This method involves dissolving a precise amount of HgO which corresponds to a predetermined amount of Hg desired in an electrolyte solution comprising glacial acetic acid and $H_2O$; this results in the dissociation of HgO and the formation of mercuric ions. In a preferred embodiment, the solution is in the relative molar concentration of one mole of glacial acetic acid/66 moles of $H_2O$. An anode and a cathode are then placed into the solution. An electric voltage is applied to the anode and the cathode creating an electric current from the anode through the electrolyte solution to the cathode, whereby mercuric ions are reduced and the required, pre-determined amount of elemental Hg plates onto the cathode. In this manner, milligram and submilligram amounts of Hg are conveniently recovered from HgO.

In another embodiment, precise milligram and submilligram amounts of Hg are recovered from mercurous chloride ($Hg_2Cl_2$) and plated onto a cathode wire. The method for doing this involves dissolving a precise amount of $Hg_2Cl_2$ which corresponds to a pre-determined milligram or submilligram amount of Hg which is desired in an electrolyte solution comprising a mixture of concentrated HCl and $H_2O$. This results in the dissociation of $Hg_2Cl_2$ and the formation of mercurous ions. In a preferred embodiment, the solution is in the relative molar concentration of one mole of HCl/57 moles of $H_2O \pm 20\%$. An anode and cathode are then placed into the solution. An electric voltage is applied to the anode and the cathode creating an electric current from the anode through the electrolyte solution to the cathode, whereby mercurous ions are reduced and the required pre-determined amount of elemental Hg plates onto the cathode.

Using this method, pre-determined accurate submilligram and milligram amounts of Hg are conveniently obtained. This eliminates the time consuming prior art techniques of obtaining minute quantities of mercury. The reduction yield range is between 90–99%. Thus, there is very little waste. In addition to this, human exposure to toxic mercury is virtually eliminated.

DETAILED DESCRIPTION OF THE INVENTION

Figure 1:
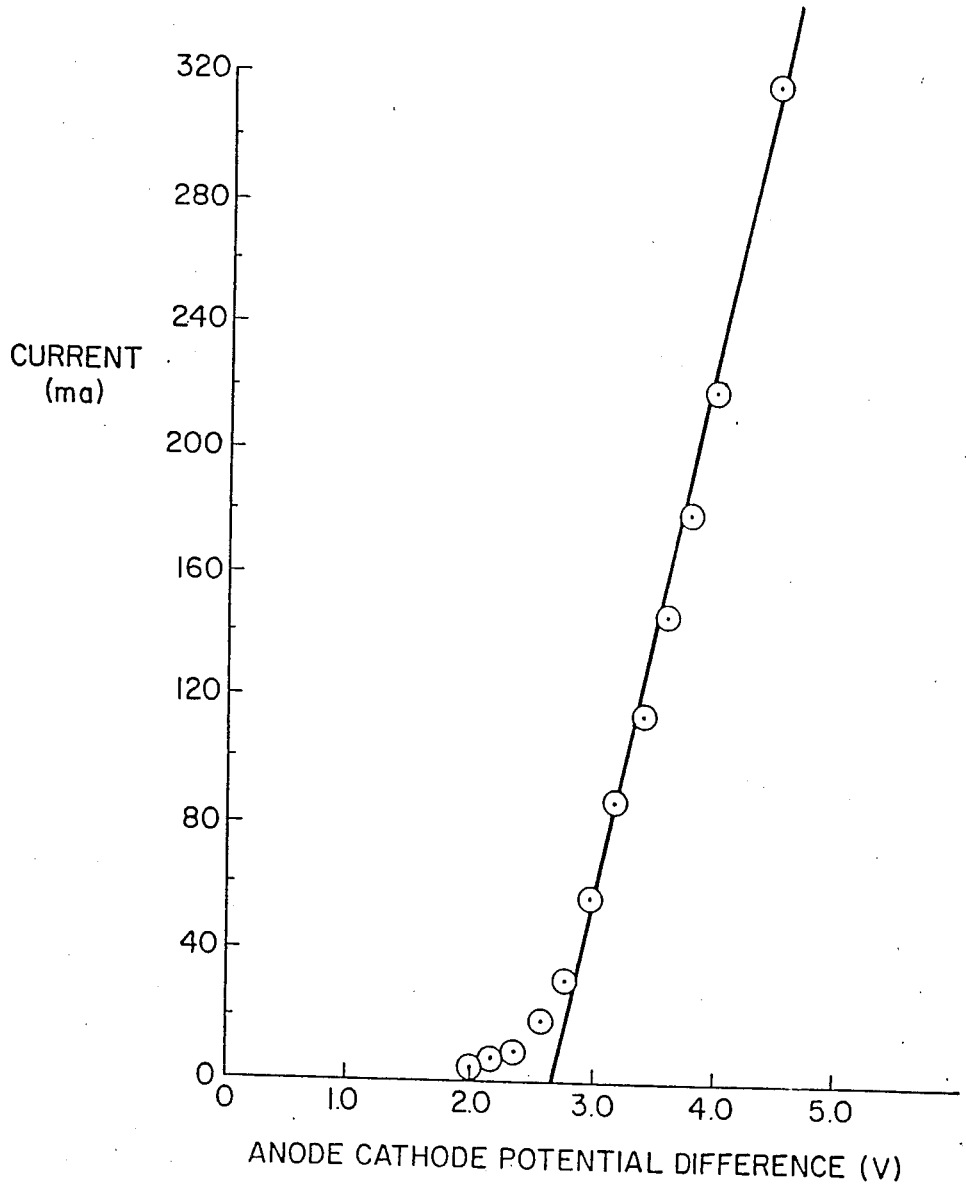
FIG. 1 is a decomposition curve for a dilute HCl solution with excess $Hg_2Cl_2$.

This invention comprises a method for obtaining pre-determined precise milligram and submilligram amounts of mercury from a corresponding precise amount of a mercury compound.

To obtain a precise, pre-determined milligram or submilligram amount of Hg from $Hg_2Cl_2$, the amount of Hg required is first determined. An amount of $Hg_2Cl_2$ is then employed which corresponds to the amount of Hg required. The pre-determined amount of $Hg_2Cl_2$ is added to an electrolyte solution containing concentrated HCl and $H_2O$. This results in the dissociation of $Hg_2Cl_2$ and the formation of mercurous ions. In a preferred embodiment, the electrolyte solution containing concentrated HCl and $H_2O$ is in the relative molar concentration of 1 mole of HCL/57 moles of $H_2O \pm 20\%$.

An anode and a cathode are placed into the electrolyte solution. An inert wire such as platinum can be used as the anode, and the wire to be plated with Hg is used as the cathode. The cathode wire can be purified copper, nickel or Niron. (Niron is a trademark for a magnetic alloy composed of about 50% nickel and 50% iron manufactured by Amax Corporation of Orangeburg, S.C.). An electric voltage of 0.9 or higher (as determined by the I–V characteristic of the system) is then applied to the solution via the anode and the cathode creating an electric current from the anode through the electrolyte solution to the cathode whereby mercurous ions are reduced and elemental mercury is plated onto the cathode. Voltages below 1.3 produce good results for unsaturated solutions of $Hg_2Cl_2$ for the types of wire cathodes mentioned above. The electrolyte solution is kept at a temperature of about 25° C.

To determine the ideal voltage which should be applied to the electrolyte solution for successful plating, the I–V or decomposition characteristic of the system must be determined. This is determined by plotting the current as a function of voltage as illustrated in FIG. 1 for the reduction of mercurous ions dissociated from $Hg_2Cl_2$ in a solution of HCl and $H_2O$. This graph shows two distinct phases. The initial phase depicts a climb in current as a high enough voltage is reached so as to allow the Hg ions to begin to be reduced. A similar type curve results when current is plotted as a function of voltage during the electrolytic reduction of mercuric ions dissociated from HgO in a solution of glacial acetic acid and $H_2O$.

At 0.9 volts, mercurous ions start to be reduced. As the voltage is further increased the current climbs very slowly indicating substantial Hg ion reduction. However, when the voltage reaches a certain point, called the breakdown voltage, the current rises sharply indicating that other chemical reactions are occurring at significant rates. The excess voltage causes these additional chemical reactions to occur.

Impurities are produced when the breakdown voltage level is reached. This is due to the electrolyte breakdown which occurs as a consequence of the additional chemical reactions which are taking place. The fact that the breakdown voltage has been reached can be determined by the fact that there is a steep increase in the current. The ammeter serves as a process parameter check rather than a direct measure of Hg plating rate, due to the fact that it signals an increase in current caused by the additional chemical reactions which are occurring.

Electrolyte decomposition is a particular problem during the electrolytic recovery of Hg from $Hg_2Cl_2$, and electrolyte breakdown or separation can become severe when the electrolyte solution is not saturated with $Hg_2Cl_2$. Under saturated solution conditions, high voltage plating produces relatively pure Hg samples. When plating takes place under the unsaturated conditions, the plated material is black and porous (possibly $Hg_2O$) and the solution becomes green (possibly mercury perchlorate being formed) unless care is taken to operate below the breakdown voltage. Most of the decomposition current is due to decomposition of the electrolyte rather than Hg ion reduction. For $Hg_2Cl_2$, even though higher voltages could yield higher deposition rates, higher voltages also result in substances other than mercury being plated. A compromise between plating rate and electrolyte breakdown must be found. The specific voltage value is determined from the I–V characteristic of the system.

However, electrolyte decomposition is not a significant problem during the electrolytic reduction of mercuric ions dissociated from HgO in an electrolyte solution of glacial acetic acid and water. The reduction of mercuric ions obtained from HgO is usually run at 50 ma for milligram and submilligram amounts of HgO. Voltages as high as 17 volts can be used to obtain this amperage without producing electrolyte decomposition. If even less electrolyte decomposition is desired, lower voltages such as six volts can be used.

As mentioned above, from the decomposition curve, it can be determined at what voltage the Hg ions start to be reduced and where the breakdown voltage lies. The voltage between that where the Hg ions begin to be reduced and that where the breakdown voltage begins lies in the I–V characteristics of the system. It is within this voltage range that optimal plating of Hg is obtained.

To obtain a pre-determined quantity of Hg from HgO, a pre-determined quantity of HgO is obtained. The HgO is then placed in an electrolyte solution containing glacial acetic acid and $H_2O$. By diluting a solution containing a particular quantity of Hg ions, one can proportion accurately, a final solution containing a very small quantity of Hg ions.

For the recovery of Hg from HgO, an inert wire such as platinum can be used as the anode and the wire to be plated with Hg is used as the cathode. A purified nickel or copper wire can be used as the cathode. To electrolytically recover Hg from HgO, the electrolyte solution used is a mixture of glacial acetic acid and $H_2O$. In a preferred embodiment, the solution is in the relative molar concentration of 1 mole of glacial acetic acid to 66 moles of $H_2O \pm 20\%$.

HgO is dissolved into the electrolyte solution, thus, dissociating and forming mercuric ions in solution. An electric voltage (the maximum specific value being determined by the I–V characteristic of the system) is then applied across the anode and the cathode creating an electric current from the anode through the electrolyte solution to the cathode whereby mercuric ions are reduced and elemental mercury is plated onto the cathode. Due to the fact that relatively high voltage is required to produce electrolyte decomposition during the reduction of mercuric ions from HgO in glacial acetic acid, very little attention is paid to voltage. Instead of voltage, amperage is the parameter which is most carefully monitored to promote the most rapid and complete reduction and plating of mercuric ions. At 50 ma, using a cathode which is 2.5 cm long and 0.05 cm in diameter, made of either copper or nickel and a 2.5 cm long 0.05 cm diameter platinum wire as the anode, one obtains rapid and complete reduction and plating of mercuric ions from HgO in glacial acetic acid and $H_2O$. 50 ma is reached by applying about 17 volts across the anode and the cathode.

The electrolyte solution is kept at a temperature of about 25° C. and the solution is stirred to promote HgO dissociation. The electrolytic reduction is continued until the reduction of Hg ions is completed. It is considered a complete reduction when 90–99% of the Hg ions, which can theoretically be reduced, have plated onto the cathode. For milligram and submilligram quantities of Hg, it usually takes 4–5 hours for reduction to be completed.

Thereupon, a cathode with a pre-determined quantity of mercury thereon is recovered. The HgO plating process appears reproducible and very efficient in removing a very large fraction of Hg ions.

The plating process is non-linear in that the plating current depends on the concentration of species. This results in an observed exponential fall off of current versus time for fixed voltage. However, by knowing initial conditions, e.g., initial electrolyte concentration and initial quantity of Hg compound, reproducible plating has been observed for milligram and submilligram quantities of Hg. The analysis of reproducibility was carried out by first plating Hg from a known initial mass of HgO and then utilizing inductively coupled plasma atomic absorption spectroscopy to determine the remaining Hg ions in solution. The point at which the reduction of Hg has been completed has also been determined by a potentiometric titration technique. For a detailed discussion of the potentiometric titration technique employed, see Overman, R. F. *Potentiometric Titration of Mercury Using the Iodide Selective Electrode as Indicator,* Anal. Chem. No. 4, 616–617 (April 1971) the teachings of which are hereby incorporated by reference.

The invention is further illustrated by the following examples.

EXAMPLE 1

Plating of a Submilligram Quantity of HgO

Materials Used 2.5 cm long 0.05 cm diameter nickel wire cathode
2.5 cm long 0.05 cm diameter platinum wire anode
Glacial acetic acid
$H_2O$
3.56 mg HgO 3.56 mg of HgO were dissolved in 100 ml of glacial acetic acid and water. The solution was in the relative molar concentration of 1 mole of glacial acetic acid/66 moles of $H_2O$. 10 ml of this solution were removed. The 10 ml of solution contained 0.35 mg of HgO or 0.330 mg of mercuric ions. The platinum anode and the nickel cathode, connected to an appropriate power supply, were placed into the 10 ml solution. Plating was carried out for 5.0 hours at 50 ma at a temperature of about 25° C. During this period, the temperature of the solution rose to 32° C.

After 5 hours, the plating was stopped and a potentiometric titration was carried out of the remaining solution. It was determined that 0.299 mg of mercuric ions were remaining in solution. This represented a 91% yield of recovered mercury.

EXAMPLE 2

Reduction of a Milligram Quantity of Mercury

Materials Used 1.02 mg $^{201}HgO$
2.5 cm long 0.05 cm diameter nickel wire cathode
2.5 cm long 0.05 cm diameter platinum wire anode
Glacial acetic acid
$H_2O$ 1.02 mg of $^{201}HgO$ was placed in solution of glacial acetic acid and water containing 19 parts of $H_2O$ for every part of glacial acetic acid. Plating was carried out for 5.5 hours at 50 ma using a 2.5 cm long 0.05 cm diameter nickel wire cathode. The remaining solution contained 0.013 mg of Hg which represents an approximate 99% recovery of Hg from the HgO.

EXAMPLE 3

Reduction of a Milligram Quantity of Mercury

Materials Used 2.0 mg of $^{201}HgO$
Distilled $H_2O$
Glacial Acetic Acid
2.5 cm long 0.05 cm diameter nickel wire cathode
2.5 cm long 0.05 cm diameter platinum wire anode 2.0 mg of $Hg^{201} \pm 10$–15% were needed. So, 2.0 mg of $^{201}HgO$ were obtained and dissolved in 10 ml of glacial acetic acid and distilled $H_2O$ in the relative molar concentration of one mole of glacial acetic acid/66 moles of $H_2O$. Plating was carried out for 4 hours at 50 ma using a 2.5 cm long 0.05 cm diameter nickel wire cathode and a 2.5 cm long 0.05 cm diameter platinum wire anode.

Potentiometric titration of the remaining solution, after the plating was completed, indicated that $2 \times 10^{-2}$ mg of $Hg^{2+}$ions remained in solution. This represented a 99% yield.

EXAMPLE 4

Reduction of Larger Amounts of Hg

Materials Used 18.6 mg HgO
Glacial acetic acid
Distilled $H_2O$
20 cm long 0.05 cm diameter nickel wire cathode
20 cm long 0.05 cm diameter platinum wire anode To determine the percentage yield of the electrolyte separation of larger masses of mercury compounds, 18.6 mg of HgO were obtained. This HgO was then dissolved in 100 ml of glacial acetic acid and $H_2O$ in the relative molar concentration of one mole of glacial acetic acid/66 moles of $H_2O$. Plating was carried out for 4.6 hours at 250 ma. A 20 cm long 0.05 cm diameter nickel wire was used as the cathode and a 20 cm long 0.05 cm diameter platinum wire was the anode used.

Potentiometric titration of the remaining solution, after the plating was completed, indicated that 1.3 mg of $Hg^{2+}$ions remained in the solution. This represented a 92% yield.

INDUSTRIAL APPLICABILITY

The invention described herein relates to a method for obtaining accurate amounts of mercury from mercury compounds. This mercury is deposited onto the cathode via electrolytic methods. Thus, the method can be applied to depositing accurate amounts of mercury into such devices as vacuum tubes, optical vapor filters and arc discharge lamps.

EQUIVALENTS

Those skilled in the art will recognize or be able to ascertain, using no more than routine experimentation, many equivalents to the specific embodiment of the invention described herein. Such equivalents are intended to be covered by the following claims.

We claim:

1. A method for obtaining a pre-determined quantity of Hg, which comprises:

(a) dissolving a quantity of HgO in an electrolyte solution resulting in the dissociation of HgO and the formation of mercuric ions in solution, said electrolyte solution comprising glacial acetic acid and $H_2O$, said quantity of HgO being sufficient to provide the pre-determined quantity of Hg plated on a cathode at an electrolyte cell upon substantially complete electrolytic reduction and plating thereof;

(b) placing an anode and a cathode into the electrolyte solution;

(c) applying an electric voltage across the anode and cathode, said electric voltage causing an electric current to flow from the anode through the electrolyte solution to the cathode, whereby mercuric ions are reduced and elemental Hg is plated onto said cathode;

(d) continuing to apply the electric voltage across the anode and cathode until the reduction of Hg ions is complete; and thereafter (e) recovering said cathode with the pre-determined quantity of Hg thereon.

2. A method as recited in claim 1, wherein the electrolyte solution of glacial acetic acid and $H_2O$ in step "a" is in the relative molar concentration of 1 mole of glacial acetic acid/66 moles of $H_2O \pm 20\%$.

3. A method as recited in claim 1, wherein the amount of HgO of step "a" is sufficient to obtain a pre-determined milligram quantity of Hg.

4. A method as recited in claim 1, wherein the amount of HgO of step "a" is sufficient to obtain a pre-determined submilligram quantity of Hg.

5. A method as recited in claim 1, wherein the cathode used in step "b" is a metal selected from the group consisting of purified copper and nickel.

6. A method for obtaining a pre-determined quantity of Hg from HgO, which comprises:

(a) dissolving a quantity of HgO in an electrolyte solution resulting in the dissociation of HgO and the formation of mercuric ions in solution, said electrolyte solution comprising glacial acetic acid and $H_2O$ in the relative molar concentration of 1 mole of glacial acetic acid/66 moles of $H_2O \pm 20\%$, said quantity of HgO being sufficient to provide the pre-determined quantity of Hg plated on a cathode of an electrolytic cell upon substantially complete electrolytic reduction and plating thereof;

(b) placing an anode and a cathode into said electrolyte solution, said cathode being a metal selected from the group consisting of purified copper and nickel;

(c) applying an electric voltage across said anode and cathode, said electric voltage creating an electric current from the anode through the electrolyte solution to the cathode, whereby mercuric ions are reduced and elemental Hg is plated onto said cathode;

(d) continuing to apply said voltage across said anode and cathode until the reduction of mercuric ions is complete; and thereafter (e) recovering said cathode with the pre-determined quantity of Hg thereon.

7. A method as recited in claim 6, wherein the amount of HgO of step "a" is sufficient to obtain a pre-determined milligram quantity of Hg.

8. A method as recited in claim 6, wherein the amount of HgO of step "a" is sufficient to obtain a pre-determined submilligram quantity of Hg.

9. A method for obtaining a pre-determined quantity of Hg from $Hg_2Cl_2$, which comprises:

(a) dissolving a quantity of $Hg_2Cl_2$ in an electrolyte solution resulting in the dissociation of $Hg_2Cl_2$ and the formation of mercurous ions in solution, said electrolyte solution being comprised of a mixture of HCl and $H_2O$, said quantity of $Hg_2Cl_2$ being sufficient to provide the pre-determined quantity of Hg plated on a cathode of an electrolytic cell upon substantially complete electrolytic reduction and plating thereof;

(b) placing an anode and a cathode into the electrolyte solution;

(c) applying an electric voltage across the anode and cathode, said electric voltage creating an electric current from the anode through the electrolyte solution to the cathode, whereby mercurous ions are reduced and elemental Hg is plated onto said cathode;

(f) continuing to apply the electric voltage across the anode and cathode until the reduction of mercurous ions is complete; and (g) recovering said cathode with the pre-determined quantity of Hg thereon.

10. A method as recited in claim 9, wherein the electrolyte solution of step "a" is comprised of a mixture of concentrated HCl and $H_2O$ in the relative molar concentration of 1 mole of HCl/57 moles of $H_2O \pm 20\%$.

11. A method as recited in claim 9, wherein the cathode of step "b" is a metal selected from the group consisting of purified nickel, copper and Niron.

12. A method as recited in claim 9, wherein the electric voltage applied in step "c" is at 0.9 volts or higher as determined by the I–V characteristics of the system.

13. A method as recited in claim 9, wherein the amount of $Hg_2Cl_2$ obtained in step "a" is the amount required to produce a pre-determined submilligram quantity of Hg.

14. A method as recited in claim 9, wherein the amount of $Hg_2Cl_2$ obtained in step "a" is the amount required to produce a pre-determined milligram quantity of Hg.

15. A method for obtaining a pre-determined amount of Hg from $Hg_2Cl_2$, which comprises:

(a) dissolving a quantity of $Hg_2Cl_2$ in an electrolyte solution resulting in the dissociation of $Hg_2Cl_2$ and the formation of mercurous ions in solution, said electrolyte solution comprising a mixture of HCl and $H_2O$ in the relative molar concentration of 1 mole HCl/57 moles of $H_2O \pm 20\%$, said amount of $Hg_2Cl_2$ being sufficient to provide the pre-determined quantity of Hg plated on a cathode of an electrolytic cell upon substantially complete electrolytic reduction and plating thereof;

(b) placing an anode and a cathode into the electrolyte solution, said cathode being a metal selected from the group consisting of purified copper, nickel and Niron;

(c) applying an electric voltage across said anode and cathode, said electric voltage creating an electric current from the anode through the electrolyte solution to the cathode whereby mercurous ions are reduced and elemental mercury plated onto the cathode, said electric voltage being 0.9 volts or higher as determined by the I–V characteristic of the system;

(d) continuing to apply the electric voltage across the anode and cathode until the reduction of mercurous ions is complete; and (e) recovering said cathode with the pre-determined quantity of Hg thereon.

16. A method as recited in claim 15, wherein the quantity of $Hg_2Cl_2$ obtained in step "a" is the quantity required to produce a pre-determined submilligram quantity of Hg.

17. A method as recited in claim 15, wherein the quantity of $Hg_2Cl_2$ obtained in step "a" is the quantity required to produce a pre-determined milligram quantity of Hg.

18. A method for obtaining a pre-determined quantity of Hg, which comprises:

(a) dissolving a mercury salt into solution resulting in the dissociation of the mercury salt and the formation of mercury ions in solution, said quantity of mercury salt being sufficient to provide the pre-determined quantity of Hg plated on a cathode of an electrolyte cell upon substantially complete electrolytic reduction and plating thereof;

(b) placing an anode and a cathode into the electrolyte solution;

(c) applying an electric voltage across the anode and cathode, said electric voltage causing an electric current to flow from the anode through the electrolyte solution to the cathode, whereby mercury ions are reduced and elemental Hg is plated onto said cathode;

(d) continuing to apply the electric voltage across the anode and cathode until the reduction of Hg ions is complete; and thereafter (e) recovering said cathode with the pre-determined quantity of Hg thereon.

* * * * *